US009799209B2

(12) United States Patent
Schindler et al.

(10) Patent No.: US 9,799,209 B2
(45) Date of Patent: Oct. 24, 2017

(54) INTRUSION SENSOR FOR MONITORING AN ENTRANCE TO A BUILDING TO BE MONITORED, AND METHOD

(71) Applicant: Robert Bosch GmbH, Stuttgart (DE)

(72) Inventors: Frank Schindler, Reutlingen (DE); Julian Bartholomeyczik, Reutlingen (DE); Christian Reichert, Nuertingen (DE); Qiulu Dai, Reutlingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/897,004

(22) PCT Filed: Jun. 5, 2014

(86) PCT No.: PCT/EP2014/061672
§ 371 (c)(1),
(2) Date: Dec. 9, 2015

(87) PCT Pub. No.: WO2014/198621
PCT Pub. Date: Dec. 18, 2014

(65) Prior Publication Data

US 2016/0117918 A1 Apr. 28, 2016

(30) Foreign Application Priority Data

Jun. 10, 2013 (DE) ..... 10 2013 210 747

(51) Int. Cl.
*G08B 13/00* (2006.01)
*G08B 29/18* (2006.01)
(Continued)

(52) U.S. Cl.
CPC ..... *G08B 29/188* (2013.01); *G08B 13/02* (2013.01); *G08B 13/08* (2013.01)

(58) Field of Classification Search
CPC ..... G08B 13/02; G08B 13/08; G08B 29/00; G08B 29/18; G08B 29/185; G08B 29/188
(Continued)

(56) References Cited

U.S. PATENT DOCUMENTS 5,793,286 A * 8/1998 Greene ..... G08B 29/183 340/522
5,870,022 A * 2/1999 Kuhnly ..... G08B 29/26 340/511
(Continued)

FOREIGN PATENT DOCUMENTS

CN 101866521 A 10/2010
DE 602005002828 T2 7/2008
(Continued)

*Primary Examiner* — Thomas Mullen
(74) *Attorney, Agent, or Firm* — Norton Rose Fulbright US LLP; Gerard Messina

(57) ABSTRACT

An intrusion sensor for monitoring an entrance to a building to be monitored, the intrusion sensor being situated at the entrance on the inside of the building, includes an acceleration sensor which is configured to detect motions of the intrusion sensor in at least one spatial axis, and in the case of a motion in the at least one axis, to output an acceleration signal, including a surroundings sensor which is configured to detect at least one value of at least one physical variable in the surroundings of the intrusion sensor, and including a plausibility check device, which is configured to carry out a plausibility check of the acceleration signal using the detected value of the physical variable, and to output an intrusion signal if the result of the plausibility check is negative. Also described is a corresponding method and an alarm system including an intrusion sensor.

12 Claims, 4 Drawing Sheets

(51) Int. Cl.
*G08B 13/02* (2006.01)
*G08B 13/08* (2006.01)

(58) Field of Classification Search
USPC ..... 340/541, 522, 545.1, 506
See application file for complete search history.

(56) References Cited

U.S. PATENT DOCUMENTS 8,253,563 B2 * 8/2012 Burnard ..... B60R 25/10 340/541
2004/0004546 A1 * 1/2004 Ando ..... E05B 45/06 340/541
2006/0028334 A1 * 2/2006 Adonailo ..... G08B 13/04 340/522
2007/0188321 A1 * 8/2007 Stenlund ..... B60R 25/1004 340/539.26
2008/0061970 A1 * 3/2008 Imai ..... G08B 13/08 340/545.1
2008/0165001 A1 * 7/2008 Drake ..... G08B 29/24 340/550
2009/0015400 A1 1/2009 Breed
2012/0268274 A1 * 10/2012 Wieser ..... G08B 13/08 340/545.2
2013/0099922 A1 * 4/2013 Lohbihler ..... G08B 13/184 340/539.17
2013/0231890 A1 * 9/2013 Schifferdecker ..... G05B 19/042 702/141
2013/0335222 A1 * 12/2013 Comerford ..... G08B 13/06 340/542

FOREIGN PATENT DOCUMENTS

DE 60 2004 011 587 1/2009
DE 10 2010 039837 3/2012
WO WO 2006/123217 11/2006

* cited by examiner

INTRUSION SENSOR FOR MONITORING AN ENTRANCE TO A BUILDING TO BE MONITORED, AND METHOD

FIELD OF THE INVENTION

The present invention relates to an intrusion sensor for monitoring an entrance to a building to be monitored, the intrusion sensor being situated at the entrance on the inside of the building. Furthermore, the present invention relates to a method for monitoring an entrance to a building to be monitored.

BACKGROUND INFORMATION

Today, it is important in many applications to detect the unauthorized opening of a door or a window. For example, alarm systems for buildings may include intrusion detectors which are situated on individual doors and windows of a building and are used to detect the opening of the door or the window.

If the alarm system is armed, it may trigger an alarm in the event of an unauthorized opening of a door or a window of the building and transmit an alarm signal, for example, to a central reporting center or to the police.

The detection of an unauthorized opening of a door or a window of a building, i.e., an intrusion via the door or the window, is carried out, for example, via a sensor which is configured to detect vibrations or jarring occurring at the door or the window due to the intrusion.

Patent document DE602004011587T2 discusses a conventional intrusion sensor for monitoring a building.

This jarring may, for example, be caused by the break-in tool used on the door lock or the window, for example, a skeleton key or other lock-picking instruments. However, this jarring may also, for example, be caused by the exertion of brute force on the door for separating the door lock from the corresponding receptacle situated in the door frame. This is the case, for example, when kicking in the door.

In this case, the sensor is generally secured to the inside of the door or the window, i.e., to the inside of the building. The sensor generally simultaneously detects accelerations in all three spatial axes and reports them to the alarm system or to a microcontroller integrated into the sensor which transmits an intrusion signal to the alarm system.

If a sensor which is attached to the inside of the door or the window only monitors motion in the three spatial axes, false alarms may be triggered very easily, since the sensor is not able to detect the actual reason for the jarring.

For example, if a child on the floor inside the dwelling bumps into a door which is equipped with a sensor as described above, it is not possible to rule out the sensor triggering an intrusion alarm, although no intrusion is occurring. Since the sensor only detects the jarring of the door, it cannot differentiate whether the door was jarred by an authorized person or an unauthorized person.

SUMMARY OF THE INVENTION

The present invention describes an intrusion sensor having the features described herein and a method having the features described herein.

Accordingly, the following is provided:

An intrusion sensor for monitoring an entrance to a building to be monitored, the intrusion sensor being situated at the entrance on the inside of the building, including an acceleration sensor which is configured to detect motions of the intrusion sensor in at least one spatial axis, and in the case of a motion in the at least one axis, to output a motion signal, in particular an acceleration signal, including a surroundings sensor which is configured to detect at least one value of at least one physical variable in the surroundings of the intrusion sensor, and including a plausibility check device which is configured to carry out a plausibility check of the motion signal, in particular the acceleration signal, using the detected value of the physical variable, and to output an intrusion signal if the result of the plausibility check is negative.

Furthermore, the following is provided:

A method for monitoring an entrance to a building to be monitored, including the steps of detecting a motion of the entrance in at least one spatial axis and outputting a motion signal, in particular an acceleration signal, in the case of a motion in the at least one axis, detecting at least one value of at least one physical variable in the surroundings of the entrance on the inside of the building, carrying out a plausibility check of the motion signal, in particular the acceleration signal, using the detected value of the physical variable, and outputting an intrusion signal if the result of the plausibility check is negative.

Finally, the following is provided:

An alarm system, including an alarm generator which is configured to output an alarm, and including at least one intrusion sensor according to the present invention which is configured to transmit an intrusion signal to the alarm generator.

Advantages of the Invention

The present invention is based on the finding that a detection of motions in three axes alone is not sufficient for preventing false alarms in an intrusion sensor.

The present invention is now based on the idea of taking this finding into account and providing an intrusion sensor which, in addition to detecting the motions of the entrance to a building, detects additional physical variables in order to carry out a plausibility check of the output of the acceleration sensor.

The present invention in particular provides for using physical variables for the plausibility check which allow the sensor to infer whether a person is situated outside the entrance to the building or inside the entrance to the building.

If a motion of the entrance, for example, jarring a door, is detected by the acceleration sensor, and an acceleration signal is output, a value of at least one of the physical variables is detected and used for carrying out a plausibility check of the acceleration signal.

If the result of the plausibility check of the acceleration signal is positive, a person is thus inside the building in the surroundings of the entrance, and no alarm is triggered despite the acceleration signal output by the acceleration sensor.

If the result of the plausibility check of the acceleration signal is negative, no person is thus inside the building in the surroundings of the entrance, and an alarm is triggered due to the acceleration signal output by the acceleration sensor.

Therefore, the present invention makes it possible to significantly reduce the number of false alarms of an intrusion sensor and thereby to increase the range of use and the acceptance of such a sensor.

Advantageous specific embodiments and refinements result from the subclaims and from the description with reference to the figures.

In one specific embodiment, the surroundings sensor is configured as a temperature sensor which is provided to detect the temperature in the surroundings of the intrusion sensor. Since a person has a body temperature of approximately 37° C., it is possible to detect the temperature on the inside of the building in the surroundings of the entrance with the aid of a temperature sensor and to use it to determine the presence of a person. This makes a precise plausibility check of the acceleration signal possible.

In one specific embodiment, the surroundings sensor is configured as a humidity sensor which is provided to detect the humidity in the surroundings of the intrusion sensor. The presence of a person causes the temperature in its surroundings to change, as described above. Simultaneously, the humidity of the air in the surroundings of a person also changes. The use of a humidity sensor therefore makes an additional plausibility check of the acceleration signal possible.

In one specific embodiment, the surroundings sensor is configured as a sensor which is provided to detect multiple physical variables simultaneously in the surroundings of the intrusion sensor. The combination of the detection of multiple physical variables makes it possible to further improve the plausibility check.

In one specific embodiment, the plausibility check device includes a memory and is configured to store a detected value of the physical variable at predefined intervals and to calculate an average of the detected values of the physical variable. If an average is formed of the detected values of the physical variable, the profile of the physical variable over time may be used during the plausibility check.

In one specific embodiment, the plausibility check device is configured to calculate a long-term average of all detected values of the physical variable. This makes it possible to calculate a highly stable average, for example, in air-conditioned spaces.

In addition or alternatively, the plausibility check device is configured to calculate a sliding average of a predefined number of detected values of the physical variable. This enables an adjustment of the average in the event of changing surroundings conditions, for example, in the event of temperature fluctuations during the course of a day.

In one specific embodiment, the intrusion sensor includes a data interface which is configured to communicate with an air conditioning system of the building and to request the instantaneous building temperature from it. The requested building temperature may also be used for a comparison with the detected value of the physical variable.

In one specific embodiment, when an acceleration signal is output by the acceleration sensor, the plausibility check device is configured to request an instantaneous value of the physical variable from the surroundings sensor and to compare it with the average, and to provide a positive result of the plausibility check of the acceleration signal if the instantaneous value of the physical variable differs from the average by less than a predefined threshold value, and to provide a negative result of the plausibility check of the acceleration signal if the instantaneous value of the physical variable differs from the average by more than the predefined threshold value. This makes it possible to adapt the plausibility check to different applications.

For example, the threshold value may be adapted in such a way that a plausibility check of temperature fluctuations may be carried out not only of adults, but also of children. However, the threshold value may also be set in such a way that temperature fluctuations or other changes of a physical variable by animals, for example, cats or dogs, may be used for an accurate plausibility check.

The embodiments and refinements mentioned above may be combined in any arbitrary manner if meaningful. Additional possible embodiments, refinements, and implementations of the present invention also include combinations of not explicitly mentioned features of the present invention previously described or described below with respect to the exemplary embodiments. In particular, those skilled in the art will also add individual aspects as improvements or refinements to each basic form of the present invention.

The present invention is described in greater detail below based on the exemplary embodiments specified in the schematic figures of the drawings.

In all figures, identical or functionally identical elements and devices have been provided with the same reference numerals, unless stated otherwise.

Within the scope of this patent application, an entrance to a building may be understood to mean an entrance to a building which may be closed via a movable closure. Entrances according to the present invention may be configured as doors, windows, or the like.

Within the scope of this patent application, an acceleration sensor may be considered to be any sensor which is configured to record acceleration, motion, vibration, or the like, in at last one of the three spatial axes. An acceleration sensor according to the present invention may also record acceleration, motion, vibration, or the like in all three spatial axes.

Within the scope of this patent application, a positive result of a plausibility check means that the plausibility check reveals that a person is inside the building in the vicinity of the entrance, so that the presence of the person may be determined by detecting the physical variables.

Within the scope of this patent application, a negative result of a plausibility check means that the plausibility check reveals that no person is inside the building in the vicinity of the entrance.

DETAILED DESCRIPTION

Figure 1:
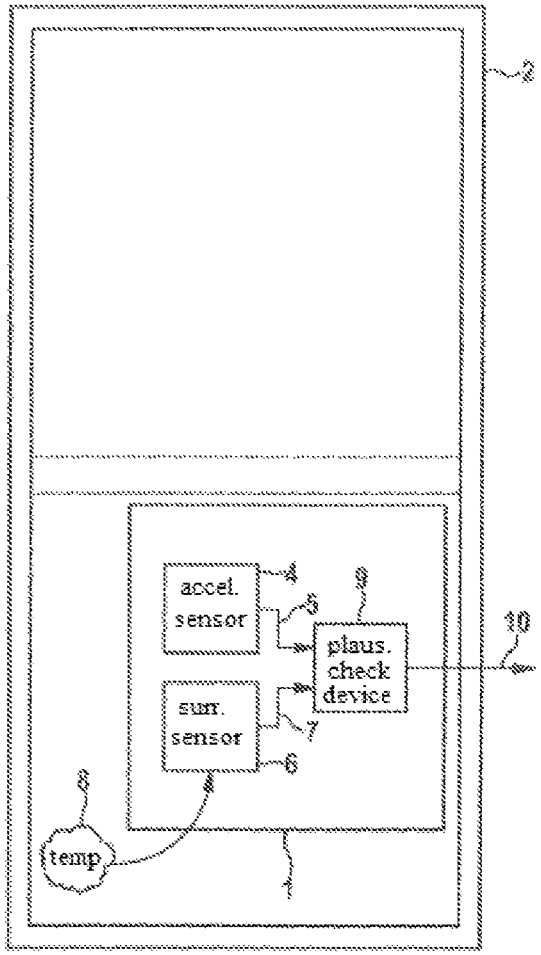
FIG. 1 shows a block diagram of one specific embodiment of an intrusion sensor according to the present invention.

FIG. 1 shows a block diagram of one specific embodiment of an intrusion sensor 1 according to the present invention.

Intrusion sensor 1 in FIG. 1 is situated at a door 2 and includes an acceleration sensor 4 which is coupled to a plausibility check device 9. Furthermore, intrusion sensor 1 in FIG. 1 includes a surroundings sensor 6 which is also coupled to plausibility check device 9.

The intrusion sensor of FIG. 1 is used for monitoring door 2, which constitutes an entrance to a building to be monitored. Thus, intrusion sensor 1 is situated at door 2 on the inside of the building.

Acceleration sensor 4 is used to detect motions of intrusion sensor 1 in at least one spatial axis. This is always the case if door 2 is moved or, for example, an intruder tampers with door 2. In the case of a motion of door 2, acceleration sensor 4 outputs an acceleration signal 5 to plausibility check device 9.

Surroundings sensor 6 detects a value 7 of temperature 8 in the surroundings of intrusion sensor 1. In one specific embodiment, surroundings sensor 6 may also be configured, additionally or alternatively, to detect other physical variables 8, for example, humidity 8. Surroundings sensor 6 provides the detected value of temperature 8 to plausibility check device 9. In other specific embodiments, surroundings sensor 6 may be configured as any arbitrary sensor which is suitable for detecting the presence or absence of a person or another living being. This may, for example, be an infrared sensor.

Finally, plausibility check device 9 carries out a plausibility check of acceleration signal 5 with the aid of the detected values 7 of temperature 8. If the result of the plausibility check is negative, plausibility check device 9 outputs an intrusion signal 10. If surroundings sensor 6 is configured, in addition or alternatively, to detect other physical variables 8, for example, humidity 8, these detected values may also be used during the plausibility check.

Figure 2:
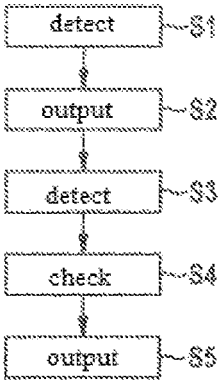
FIG. 2 shows a flow chart of one specific embodiment of the method according to the present invention.

FIG. 2 shows a flow chart of one specific embodiment of a method according to the present invention.

In a first step S1, the method according to the present invention provides for detecting motions of entrance 2, 3 in at least one spatial axis, and in a second step S2, outputting an acceleration signal 5 in the case of a motion in the at least one axis.

In a third step S3, at least one value 7 of at least one physical variable 8 is detected in the surroundings of entrance 2, 3 on the inside of building 14.

Furthermore, the method provides for checking the plausibility S4 of acceleration signal 5 using detected value 7 of physical variable 8 and outputting S5 an intrusion signal 10 if the result of the plausibility check is negative.

Figure 3:
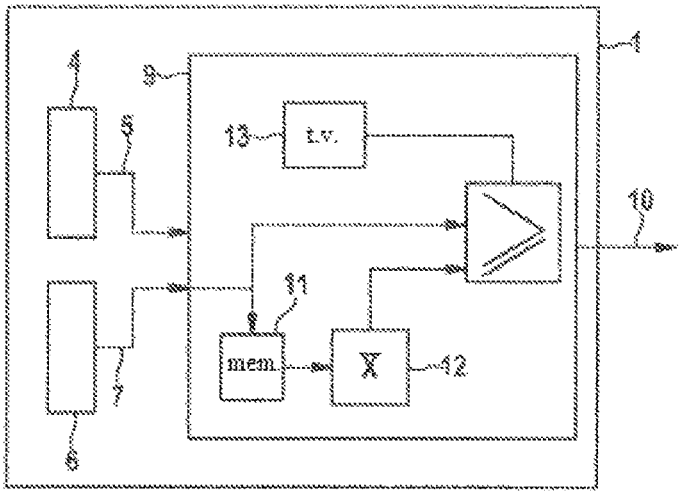
FIG. 3 shows a block diagram of an additional specific embodiment of an intrusion sensor according to the present invention.

FIG. 3 shows a block diagram of another specific embodiment of an intrusion sensor 1 according to the present invention.

Intrusion sensor 1 of FIG. 3 is based on intrusion sensor 1 of FIG. 1 and differs from it in such a way that plausibility check device 9 includes a memory 11 and is configured to store a detected value 7 of physical variable 8 at predefined intervals and to calculate an average 12 of detected values 7 of physical variable 8.

Plausibility check device 9 thus forms a long-term average 12 of all detected values 7 of physical variable 8. In one specific embodiment, plausibility check device 9 may also calculate a sliding average 12 of a predefined number of detected values 7 of physical variable 8.

When an acceleration signal 5 is output by acceleration sensor 4, plausibility check device 9 of FIG. 3 is furthermore configured to request an instantaneous value 7 of physical variable 8 from surroundings sensor 6 and to compare it with average 12.

If instantaneous value 7 of physical variable 8 differs from average 12 by more than a predefined threshold value 13, plausibility check device 9 provides a positive result of a plausibility check of acceleration signal 5, and no intrusion signal 10 is output.

If instantaneous value 7 of physical variable 8 differs from average 12 by less than predefined threshold value 13, plausibility check device 9 provides a negative result of a plausibility check of acceleration signal 5, and an alarm is triggered or an intrusion signal 10 is output.

In one specific embodiment, surroundings sensor 6 is configured as a sensor 6 which is provided to simultaneously detect multiple physical variables 8 in the surroundings of intrusion sensor 1. For example, sensor 6 may detect the temperature and the humidity.

In one specific embodiment, intrusion sensor 1 includes a data interface which is configured to communicate with an air conditioning system of building 14 and to request the instantaneous building temperature from it. The requested building temperature may also be used for a comparison with the detected value of physical variable 8.

Figure 4:
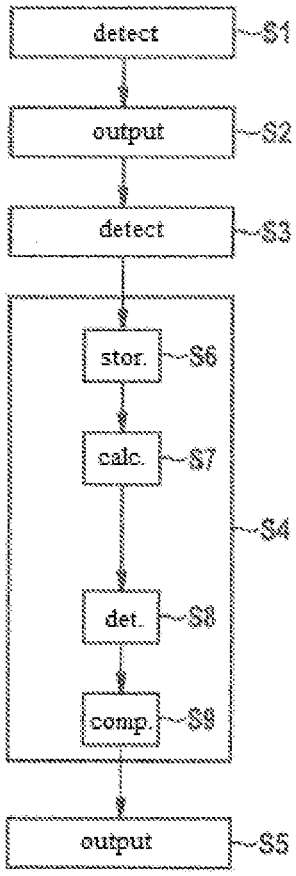
FIG. 4 shows a flow chart of an additional specific embodiment of a method according to the present invention.

FIG. 4 shows a flow chart of another specific embodiment of a method according to the present invention.

The method of FIG. 4 is based on the method of FIG. 2 and differs from it in such a way that the step of carrying out a plausibility check S4 provides for storing S6 a detected value 7 of physical variable 8 at predefined intervals and calculating S7 an average 12 of detected values 7 of physical variable 8.

Thus, when calculating S7 average 12, a long-term average 12 may be calculated for all detected values 7 of physical variable 8. In addition or alternatively, when calculating S7 average 12, a sliding average 12 may be calculated of a predefined number of detected values 7 of physical variable 8.

Furthermore, when carrying out a plausibility check S4, the method provides that when an acceleration signal 5 is output by acceleration sensor 4, an instantaneous value 7 of physical variable 8 is detected S8 and compared S9 with average 12.

Thus, the result of the plausibility check of acceleration signal 5 is positive if instantaneous value 7 of physical variable 8 differs from average 12 by more than a predefined threshold value 13. Furthermore, the result of the plausibility check of acceleration signal 5 is negative if instantaneous value 7 of physical variable 8 differs from average 12 by less than predefined threshold value 13.

Figure 5:
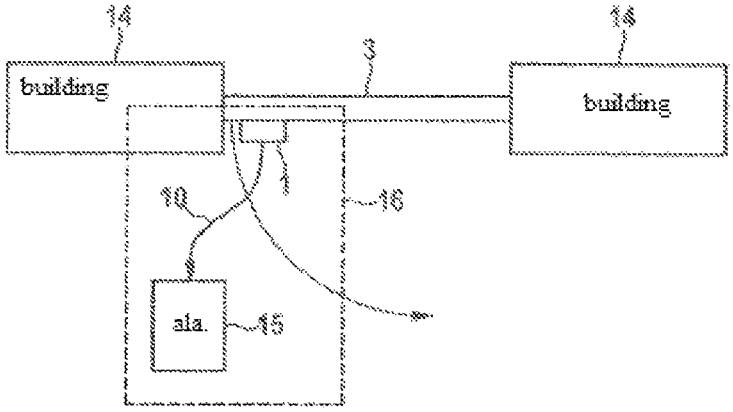
FIG. 5 shows a block diagram of a building including one specific embodiment of an intrusion sensor according to the present invention.

FIG. 5 shows a block diagram of an alarm system 16 having one specific embodiment of an intrusion sensor 1 according to the present invention.

Alarm system 16 is situated in a building 14. Building 14 of FIG. 5 is only schematically represented by two wall sections 14 which have an opening in which a window 3 is situated, at which an intrusion sensor 1 according to the present invention is situated.

In FIG. 5, the opening direction of window 3 is indicated by a curved arrow.

The opening direction in FIG. 5 is only depicted by way of example and does not necessarily have to be limited to the vertical spatial axis shown in FIG. 5. For example, should the door/window be damaged through the use of great force, a rotational tilting motion may also result which is not exclusively described by the vertical spatial axis.

Alarm system 16 includes an alarm generator 15 which is coupled to intrusion sensor 1.

Intrusion sensor 1 is configured to transmit an intrusion signal 10 to alarm generator 15, which subsequently outputs an alarm.

Although the present invention has been described above based on the exemplary embodiments, it is not limited thereto, but may be modified in a variety of ways. In particular, the present invention may be changed or modified in manifold ways without departing from the core of the present invention.

What is claimed is:

1. An intrusion sensor for monitoring an entrance to a building to be monitored, the intrusion sensor being adapted to be situated at the entrance inside of the building, comprising:

an acceleration sensor configured to detect a motion in the surroundings of the entrance to the building in at least one spatial axis, and based on the detected motion, configured to output a motion signal;

a surroundings sensor configured to detect at least one physical variable in the surroundings of the intrusion sensor; and a plausibility check device configured to perform a plausibility check of the motion signal based on at least one value of the detected at least one physical variable, and configured to output an intrusion signal if a result of the plausibility check is negative, wherein the plausibility check device includes a memory and is configured to store the at least one value of the detected at least one physical variable at predefined intervals and is configured to calculate an average of the at least one value of the detected at least one physical variable.

2. The intrusion sensor of claim 1, wherein the surroundings sensor includes at least one of a temperature sensor which detects the temperature in the surroundings of the intrusion sensor and a humidity sensor to detect the humidity in the surroundings of the intrusion sensor.

3. The intrusion sensor of claim 1, wherein the plausibility check device is configured to perform at least one of:

(i) determining a long-term average of all values of the detected at least one physical variable; or (ii) determining a sliding average of a predefined number of values of the detected at least one physical variable.

4. The intrusion sensor of claim 1, wherein, when the motion signal is output by the acceleration sensor, the plausibility check device is configured to:

request an instantaneous value of the detected at least one physical variable from the surroundings sensor and compare it with the average, provide a positive result of the plausibility check of the motion signal if the instantaneous value of the detected at least one physical variable differs from the average value by more than a predefined threshold value, and provide a negative result of the plausibility check of the motion signal if the instantaneous value of the detected at least one physical variable differs from the average by less than the predefined threshold value.

5. The intrusion sensor of claim 1, wherein the motion signal is an acceleration signal.

6. A method for monitoring an entrance to a building to be monitored, the method comprising:

detecting a motion of the entrance to the building in at least one spatial axis and outputting a motion signal based on the detection;

detecting at least one physical variable in the surroundings of the entrance to the building;

performing a plausibility check of the motion signal based on at least one value of the detected at least one physical variable; and outputting an intrusion signal if a result of the plausibility check is negative, wherein the plausibility check provides for storing the at least one value of the detected at least one physical variable at predefined intervals and calculating an average of the at least one value of the detected at least one physical variable.

7. The method of claim 6, wherein at least one of the temperature or the humidity is detected when detecting the at least one physical variable.

8. The method of claim 6, wherein at least one of the following is performed:

(i) determining a long-term average of all values of the detected at least one physical variable when calculating the average; and (ii) determining a sliding average of a predefined number of values of the detected at least one physical variable when calculating the average.

9. The method of claim 6, wherein, when performing a plausibility check, an instantaneous value of the detected at least one physical variable is detected and compared with the average, wherein the result of the plausibility check is negative if the instantaneous value of the detected at least one physical variable differs from the average by less than a predefined threshold value, and wherein the result of the plausibility check is positive if the instantaneous value of the detected at least one physical variable differs from the average by more than the predefined threshold value.

10. The method of claim 6, wherein the motion signal is an acceleration signal.

11. An alarm system, comprising:

an alarm generator configured to output an alarm; and at least one intrusion sensor configured to transmit an intrusion signal to the alarm generator, wherein the intrusion sensor is configured to monitor an entrance to a building to be monitored, wherein the intrusion sensor includes:

an acceleration sensor configured to detect a motion in the surroundings of the to the building in at least one spatial axis, and based on the detected motion, configured to output a motion signal;

a surroundings sensor configured to detect at least one physical variable in the surroundings of the intrusion sensor; and a plausibility check device configured to perform a plausibility check of the motion signal based on at least one value of the detected at least one physical variable, and configured to output an intrusion signal if a result of the plausibility check is negative, wherein the plausibility check device includes a memory and is configured to store the at least one value of the detected at least one physical variable at predefined intervals and is configured to calculate an average of the at least one value of the detected at least one physical variable.

12. The alarm system of claim 11, wherein the motion signal is an acceleration signal.

* * * * *